US005457904A

United States Patent [19]

Colvin

[11] Patent Number: 5,457,904

[45] Date of Patent: Oct. 17, 1995

[54] PERSONALIZED CALENDAR AND SYSTEM FOR MAKING

[76] Inventor: Richard R. Colvin, Orchard Hill Rd., Katonah, N.Y. 10536

[21] Appl. No.: 780,612

[22] Filed: Oct. 23, 1991

[51] Int. Cl.[6] ..... G09D 3/04

[52] U.S. Cl. ..... 40/119; 40/107

[58] Field of Search ..... 283/2, 4, 67; 40/119, 40/107; 101/483; 53/396

[56] References Cited

U.S. PATENT DOCUMENTS

| | | | |
|---|---|---|---|
| 1,371,269 | 3/1921 | Stevens | 40/119 |
| 1,798,586 | 3/1931 | Burgess | 40/119 |
| 1,990,739 | 2/1935 | Larkin | 40/119 |
| 2,128,989 | 9/1938 | Dickerson | 40/119 |
| 3,605,306 | 9/1971 | Diambra et al. | 40/119 X |
| 3,883,971 | 5/1975 | Weiss | 40/119 |
| 4,720,123 | 1/1988 | Chelius | 283/2 |
| 4,852,795 | 8/1989 | Volk, Jr. | 229/92 |
| 4,887,373 | 12/1989 | Macaulay | 40/119 |
| 5,039,132 | 8/1991 | Anderson | 283/67 |
| 5,104,146 | 4/1992 | Schulz et al. | 283/2 |

OTHER PUBLICATIONS

The Next Step, Variable information in action: Ed Owen High Volume Printing, Jun. 1990.

Magazine Week, May 20–24, 1991, No. 170.

ElectroPress Brochure (undated).

Printing News East, "Day arrives for AM's Unique ElectroPress", Jun. 11, 1990 by Cahners Publishing Co.

Reprint From Print Action: "ElectroPress: next step on the leading edge", 4 pp. (undated).

*Primary Examiner*—Kenneth J. Dorner

*Assistant Examiner*—Milton Nelson, Jr.

[57] ABSTRACT

A personalized calendar is provided comprising a plurality of pages printed/imaged with a tabular array of calendar units and at least one event reminder printed in an appropriate one of the calendar units. Preferably, the pages are bound together with a cover releasably sealable for mailing. A system and method for producing personalized calendars is also provided.

9 Claims, 7 Drawing Sheets

PERSONALIZED CALENDAR AND SYSTEM FOR MAKING

FIELD OF THE INVENTION

This invention relates to calendars and systems for printing variable information. More specifically, this invention relates to personalized or customized calendars and to variable information printing/imaging systems for producing customized calendars.

BACKGROUND ART

Calendars, diaries and other appointment/reminder booklets are well known and widely used. These prior art calendars are typically either provided bound in their own leather or the like covers, or as refills for leather or the like wallets or binders. DAY-TIMERS, INC. is an example of a company offering such refill calendars. Some calendar refills are provided as stitched or wire bound and typically include covers of index stock or the like for insertion in wallets. Other calendar refills are provided as loose-leaf pages for replacement in binders.

Although such prior art calendars are available in a variety of formats, and for a variety of special interests, they do not include event or other information of particular interest to a single person and also permit handwritten notes on the calendar unit.

Systems for printing/imaging variable information are known in the art. For example, an ELECTROPRESS® imager (AM GRAPHICS, Dayton, Ohio) is capable of imaging either a single side of a web in two colors with variable information, or two sides of a web in a single color with variable information. All variable information however must be input by hand to a data file, and pages are composed seriatum during printing.

Sheet folder/trimmers are known and used with the ELECTROPRESS imager and other less sophisticated printing presses.

SUMMARY OF THE INVENTION

Accordingly, it is an object of the invention to provide a calendar including information of particular interest to a single person or a small number of persons.

Another object of the invention is to provide a calendar including information pertaining to an event of particular interest to a person which is printed/imaged in an appropriate one of a plurality of calendar units on the calendar.

A further object of the invention is to provide a customized calendar bound within a personalized cover.

Yet another object of the invention is to provide a personalized calendar having a cover adapted to display a name and address for mailing.

A still further object of the invention is to provide a method of producing a calendar of the above character.

Still another object of the invention is to provide a system of producing a calendar of the above character.

These and other objects are achieved by provision of a calendar comprising a stack or assemblage of pages printed/imaged with a tabular array of calendar units and at least one event reminder printed in an appropriate one of said calendar units, and a cover having first and second flaps and adapted to display an address, the pages bound between the flaps. Preferably, the address is printed on the cover and the flaps are releasably sealable for mailing. Most preferably, the cover includes a third flap which is removably connected to the first flap in a perforated fold line and is releasably sealable to the second flap to form a mailing packet for the pages.

In another aspect, the invention relates to a method of producing the calendar comprising the steps of receiving an item of data pertaining to an event of interest to a person, providing paper, printing a tabular arrangement of calendar units on the paper, printing the event of interest in an appropriate one of the calendar units, arranging the paper into a stack of calendar pages, and inserting the calendar pages into a delivery packet. Preferably, the method includes the step of receiving the person's address; and printing the person's address on an outer portion, most preferably on the delivery packet, of the calendar. Preferably, the method includes binding the stack of calendar pages, most preferably to a cover which comprises the delivery packet.

In another aspect, the invention relates to a system for producing the calendars comprising an imager; means for storing data indicative of a person; means for storing information pertaining to events; a programmable controller for operating the imager; and a program for execution by the imager; the program having the steps of retrieving person indicative data, using the person indicative data to select event information, printing a calendar including the selected current event information. Preferably, the person indicative data includes a person's address; and the program includes the step of printing the person's address on an outer portion, most preferably a cover, of the calendar.

The invention and its particular features will become more apparent from the following detailed description considered with reference to the accompanying drawings.

DETAILED DESCRIPTION OF THE INVENTION

Figure 1:
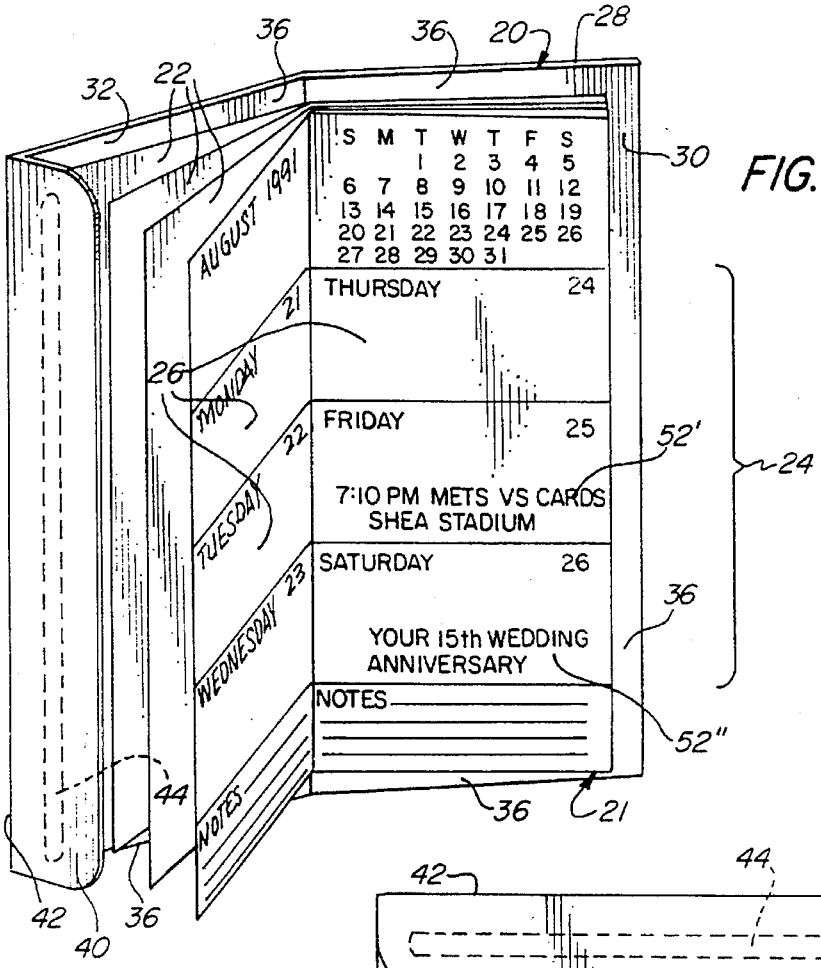
FIG. 1 is a front isometric view of one embodiment of a personalized calendar in accordance with this invention.
Figure 1A:
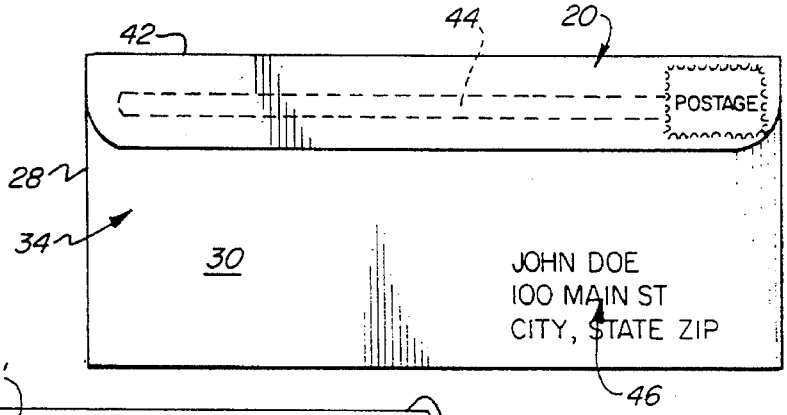
FIG. 1A is a front view of the personalized calendar of FIG. 1 releasably sealed.
Figure 1B:
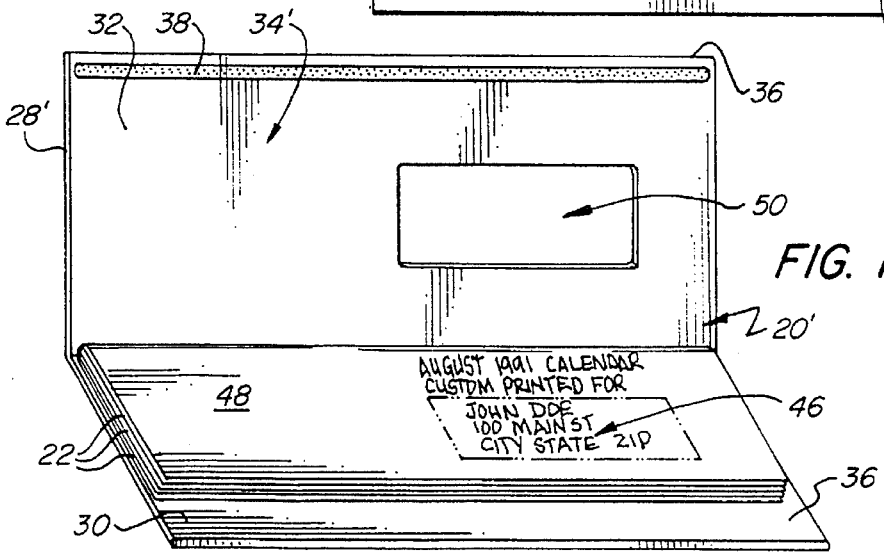
FIG. 1B is a front isometric view of another embodiment of the personalized calendar of FIG. 1.

Referring to FIGS. 1, 1A and 1B two embodiments of a customized or personalized calendar 20, 20' are generally shown. Personalized calendars 20, 20' comprise a stack 21 of calendar pages 22 of text stock imaged or printed with a tabular arrangement 24 of calendar units 26 (FIG. 1 only). Preferably the calendar page text stock is provided in the range of between about 35 and 55 lbs. At lower weights, the text stock is most preferably specified "opaque". Calendar units 26 are spaces representing or relating to hours, days, weeks, months, years, other units of time, or combinations of these which are large enough to receive notes or reminders handwritten by a user. Preferably, each calendar unit includes an identifying numeral printed therein. Days are generally preferred. Calendar pages 22 are preferably bound together by known methods in diary or booklet form (including spiral, wiral, etc.), however, calendar pages 22 may also be provided in loose-leaf form for replacement or insertion in a binder.

Preferably, calendar pages 22 are inserted, and most preferably bound together, within a cover 28, 28' including a front flap 32 and a back flap 30 which aid in protecting calendar pages 22. Where calendar 20, 20' is a refill type calendar, flaps 30, 32 are preferably formed from index stock, and may also be used to insert calendar 20, 20' into a leather or like wallet (not shown in any Figure) in a known manner. Preferably, the cover index stock is provided in the range of between about 100 and 120 lbs. Where calendar 20, 20' is not a refill type calendar, cover 28 may also be formed, for example, from leather, TYVEK® non woven fabric or other relatively durable material.

Cover 28, 28' preferably also comprises a unitary delivery or mailing packet 34, 34' for respective personalized calendar 20, 20', although it is understood that a separate mailing packet such as an envelope may also be used for delivery of calendar pages 22 with or without cover 28, 28'. Such an envelope may be preprinted or imaged in line with the personalized calendar. In this regard, flaps 30, 32 preferably overhang calendar pages 22, as indicated at 36, in order to aid in protecting them from damage during delivery. Preferably also, flaps 30, 32 are releasably sealed together around calendar pages 22.

As illustrated in FIG. 1B, at least one overhanging portion 36 of flaps 30, 32 of personalized calendar 20' includes a glue line 38 for releasably sealing the flaps together, however, sealing tabs or the like may also be used. Preferably peelable "fugitives" glue or the like is used for glue line 38.

As illustrated in FIGS. 1 and 1A, personalized calendar 20 includes a third or sealing flap 40 connected to front flap 32 at a fold line 42. Sealing flap 30 may be folded over and releasably sealed, preferably by a glue line 44 which most preferably is "fugitives" glue, to back flap 30 of cover 28. It is understood that sealing flap 40 may also be connected to front flap 32 and releasably sealed to back flap 30. Further, fold line 42 is preferably perforated so that sealing flap 40 may be relatively quickly and easily removed from cover 28 upon completion of delivery.

Cover 28, 28' is preferably adapted to display the subscriber or user's address for delivery of personalized calendar 20, 20'. As illustrated in FIG. 1A, an address 46 may be directly printed upon mailing packet 34 either before or after stack 21 of calendar pages 22 is inserted therein. Further, where, as illustrated, cover 28 comprises mailing packet 34, address 46 may be printed on flap 30, 32 either before or after calendar pages 22 are combined, and preferably bound, with cover 28.

As illustrated in FIG. 1B, address 46 may alternatively be printed on an outer page 48 of calendar pages 22. In this regard, cover 28' and any delivery packet 34' include a window 50 which may be formed for example by die-cutting. Window 50 exposes address 46 as indicated by dashed lines 52 upon releasably sealing cover 28' and/or mailing packet 34' which is preferably at least 3½ by 5 inches.

Calendar pages 22 may be virtually any size, however, mailing packet 34 is preferably at least about 3 by 5 inches or otherwise dimensioned as required by the Postmaster.

Returning to FIG. 1, in addition to tabular arrangement 24 of calendar units 26, personalized calendars 20, 20' include at least one event reminder 52 directly printed in an appropriate one of calendar units 26. For example, event reminder 52' reminds a subscriber or user of calendar 20 that on Thursday, Aug. 22, 1991, the New York Mets play the St. Louis Cardinals in Shea Stadium at 7:10 PM; event reminder 52' reminds a subscriber or user that his or her 15th anniversary is Friday, Aug. 23, 1991. Event reminder 52" is an example of a subject matter (N.Y. Mets) reminder which may be of interest to a relatively large number of users. Event reminder 52" is an example of a personal reminder which is likely only of interest to a single or relatively small number of users.

Figure 2:
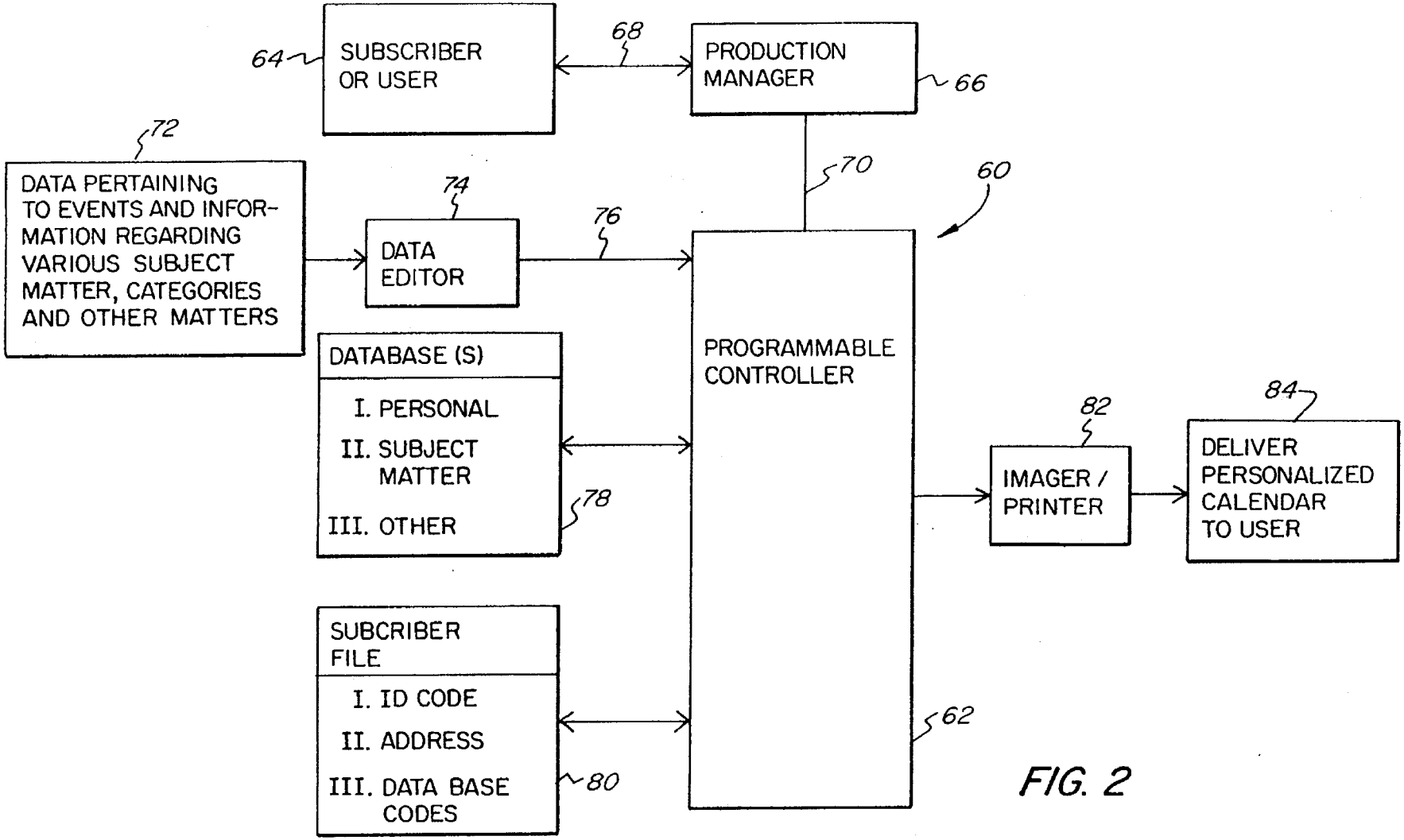
FIG. 2 is a block diagram of a system for producing the personalized calendar of FIG. 1.

Referring now to FIG. 2, a block diagram generally depicts a system 60 for producing personalized calendar 20, 20'. Programmable controller 62 is the central component of system 60. Programmable controller 62 receives input from a subscriber or user 64 via a production manager 66 along lines 68 and 70. Production manager 66 may be a person or software which communicates with user 64 and oversees calendar production system 60. For example, manager 66 may communicate system or calendar limitations such as the page length or the total number of event reminders which may be printed in a single calendar unit 26 on calendar 20, 20' to user 64. Alternatively, user 64 may input data directly to controller 62.

Transmission of data between user 64 and controller 62 is preferably accomplished with telecommunication links by touch-tone phone, computer and modem, voice recognition, or like means. It is understood that transmission may also be made by mail and manual data entry or optical character reader, or otherwise.

Data transmitted by user 64 most often comprises the user's address; personal events or other date information such as birthdays, anniversaries, schedules and the like; or other personal information such as investment portfolio content, children's schools for school events, travel plans, hobby and leisure interests and the like. Further, user 64 preferably is "editor-in-chief" of his own calendar insofar as he may directly specify to controller 62 the desired content of his personalized calendar 20, 20'.

Programmable controller 62 may also receive input from any of a variety of other sources, indicated at 72, such as on-line databases, news and information services, and the like. This data is preferably edited for length, content and format at 74; and organized into appropriate subject matter categories for storage in appropriate ones of databases 78.

Subject matter category data may for example include schedules for a variety of events such as art openings, sport events, professional conferences, and the like; tips on hobby interests such as cooking, golf, quilting, and the like; health tips or diet and exercise program reminders and information on travel destinations; coupons, advertisements, discount, rebate or other sales incentives, and the like organized by subject matter, geographic location or date; stock, bond and mutual fund prices, and the like; credit, charge card or other past purchase records; and other possibilities known to marketers.

Subscriber input is also organized by subject matter categories, and stored by controller 62 in appropriate ones of databases 78. Further, subscriber input is used by controller 62 to create a subscriber file 80 which includes a subscriber's address, subscriber identification code, and database codes for identifying the appropriate variable information for each subscriber's calendar. Controller 62 may assign weights or scores to the database codes or individual items of variable information for use in selecting particular items of variable information and in determining the overall content of the calendar. Also, user 64 may desire or be requested to periodically update subscriber file 80 such that the calendar becomes an interactive tool for regulating diet, other health or commercial habits and behavior.

To print a personalized calendar 20, 20', controller 62 matches codes from subscriber file 80 with data-base 78 to select the appropriate variable information for each subscriber's calendar. It is understood that tabular arrangement 24 of calendar units 26 (see FIG. 1) is substantially the same for each personalized calendar 20, 20'; but that the variable information may differ for each calendar. Generally, each calendar is personalized or customized with at least one event reminder printed in an appropriate one of the calendar units. Preferably, the personalized calendars 20, 20' will include additional personal/custom information such as personal or subject matter event reminders, personal information, subject matter information, coupons or advertisements, and the like either directly selected by user 64 or selected by controller 62 with reference to other data pertaining to the user. Whenever such additional information is included in a calendar, controller 62 also preferably tabulates such inclusions in order to either remit payment for use of proprietary material or prepare invoices for coupons, advertisements, or the like. Most preferably, such additional information is selected with reference to a particular user so that, for example, a coupon would have improved value to both the user and the advertiser.

Tabular arrangement 24 and the variable information are preferably substantially simultaneously printed/imaged at 82, although several runs may be made to image in different colors or to image variable information onto a preprinted tabular arrangement. Finally, personalized calendar 20, 20' is delivered, preferably mailed, to the subscriber or user at 84.

Figure 3A:
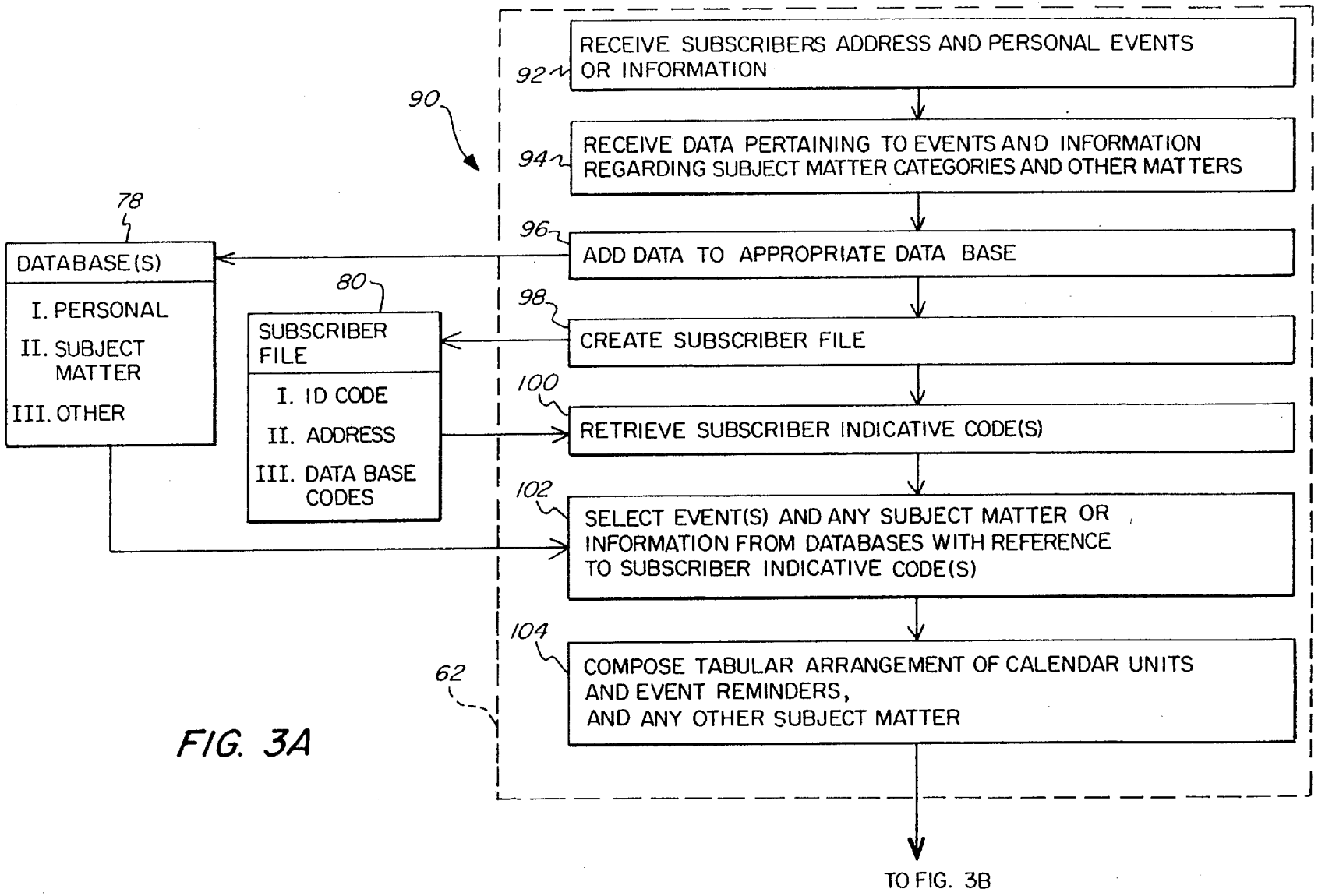
FIGS. 3A and 3B are a flow diagram depicting a method of producing the personalized calendar of FIG. 1.
Figure 3B:
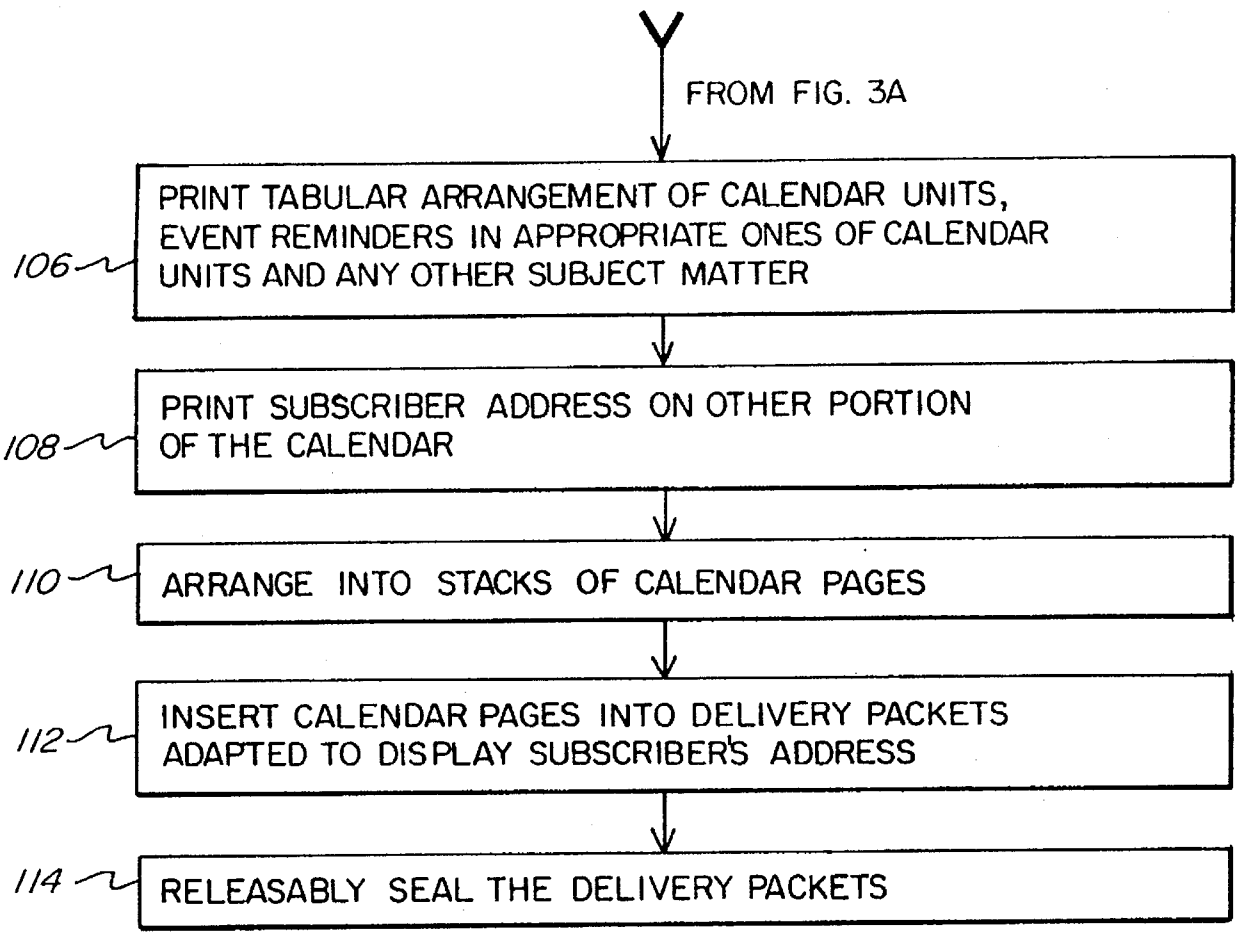

Referring now to the flow diagram of FIGS. 3A and 3B, a method 90 of producing personalized calendar 20, 20' is generally shown. Method 90 begins at 92 with receipt of the subscriber or user's address, and other personal events or information. At 94, controller 62 receives data pertaining to events and information regarding various subject matter categories, and other matters. The received data and information is added at 96 to appropriate ones of databases 78. Subscriber file 80 is created at 98.

Then, when printing of a personalized calendar 20, 20' is initiated by production manager 66, programmable controller 66, user 64 or otherwise, the subscriber's database codes are retrieved from subscriber file 80 at 100. Programmable controller 62 utilizes the subscriber data codes at 102 to select the appropriate variable information including events and any subject matter or other information from databases 78 in order to produce a particular subscriber's personalized calendar. The selected variable information preferably includes at least one event reminder. Text and any graphics for the selected variable information is generated and composed with the tabular arrangement of calendar units into a calendar at 104.

The tabular arrangement of calendar units, event reminders in appropriate ones of the calendar units, and any other subject matter or information on calendar pages 22 (see FIG. 1) is printed by imager/printer 82 at steps 106 with data provided by programmable controller 62. Data from subscriber file 80 is used at 108 to print the subscriber's address on an outer portion of the calendar (see FIGS. 1A and 1B). The printed calendar is then formed at 110 into a stack or assemblage 21 of calendar pages 22 (see FIG. 5). Stack 21 of calendar pages 22 is inserted at 112 into a delivery packet 34, 34' adapted to display the subscriber's address. Finally, delivery packet 34, 34' is releasably sealed for sending personalized calendar 20, 20' to the subscriber. As discussed above, delivery packet 34, 34' preferably comprises cover 28, 28' which is most preferably bound together with calendar pages 22.

Figure 4:
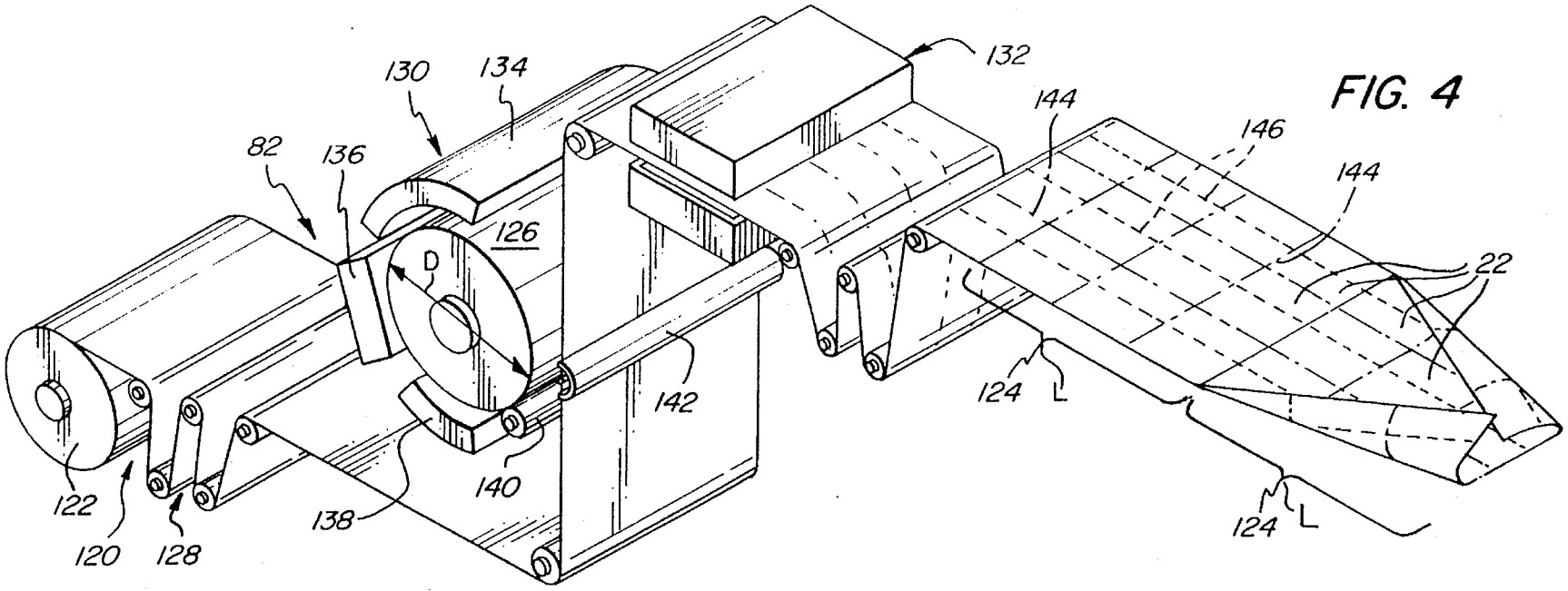
FIG. 4 is an isometric schematic diagram depicting a web printing/imaging press which may be used to produce the personalized calendar of FIG. 1.

Referring now to FIG. 4, printer/imager 82 is schematically depicted. Imager 82 images personalized calendar 20, 20' on a web 120 of paper which is conveniently provided on a spool 122 for ease of handling. Sections 124 of web 120 each represent a single personalized calendar 20, 20'.

Imager 82 includes web tensioning section 128, an imaging section 130, and a drying and cooling section 132. Imaging section 130 includes a charging corona 134, an imaging device 136, a developer 138, a toner metering roll 140, and a transfer corona 142. Each drum is generally capable of printing/imaging variable information in one color on a single side of web 120 for each pass. Additional imaging drums 126 or passes of web 120 may be utilized as necessary to image personalized calendar 20, 20' in the desired number of colors, or on both sides of web 120.

After imaging, each section 124 is folded in thirds, the beginning of which is illustrated. Sections 124 may each contain a plurality of calendar pages 22 as indicated by boundary lines 144 and fold lines 146. At some point during folding, preferably after the first folding step, section 124 is separated from web 120.

Figure 5:
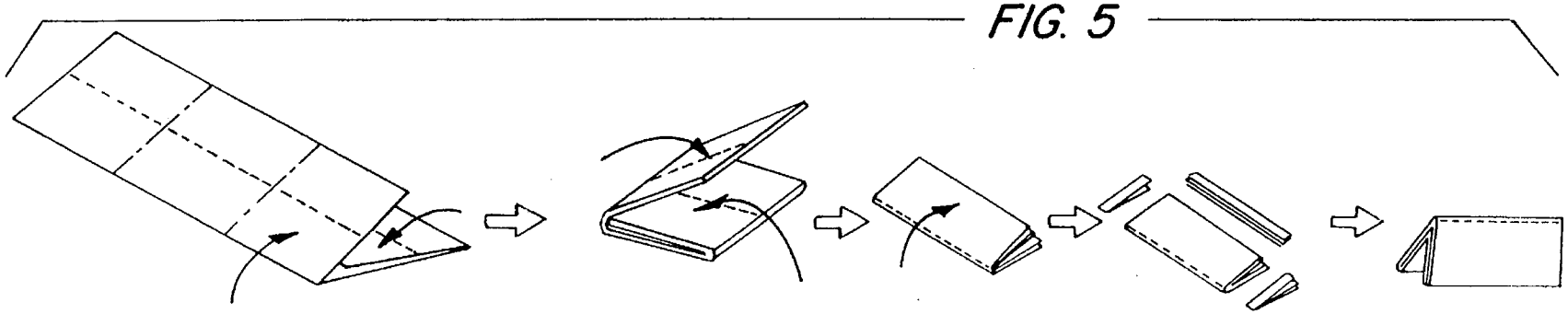
FIG. 5 is a schematic diagram depicting the forming of the web of paper into a stack of calendar pages for the personalized calendar of FIG. 1.

Referring now to FIG. 5 the folding and trimming of separated sections 124 by a sheet folder/trimmer (not shown in any Figure) into stack 21 of calendar pages 22 is schematically depicted. Generally, section 124 is folded over upon itself along every boundary line 144 and then along fold line 146. The three edges of folded section 124 other than fold line 146 are then trimmed.

After trimming, stack 21 of calendar pages 22 is placed on a saddle 148 for assembly with cover 28, 28'. Other methods such as PERFECT BIND binding may also be used. One advantage of such methods is that single page coupons which may be four color can be bound together with the personalized calendar. Referring now to FIGS. 6A, 6B, 7A and 7B, flow and corresponding schematic diagrams depict the assembly of respective personalized calendars 20, 20' as illustrated in FIGS. 1A and 1B.

Figure 6A:
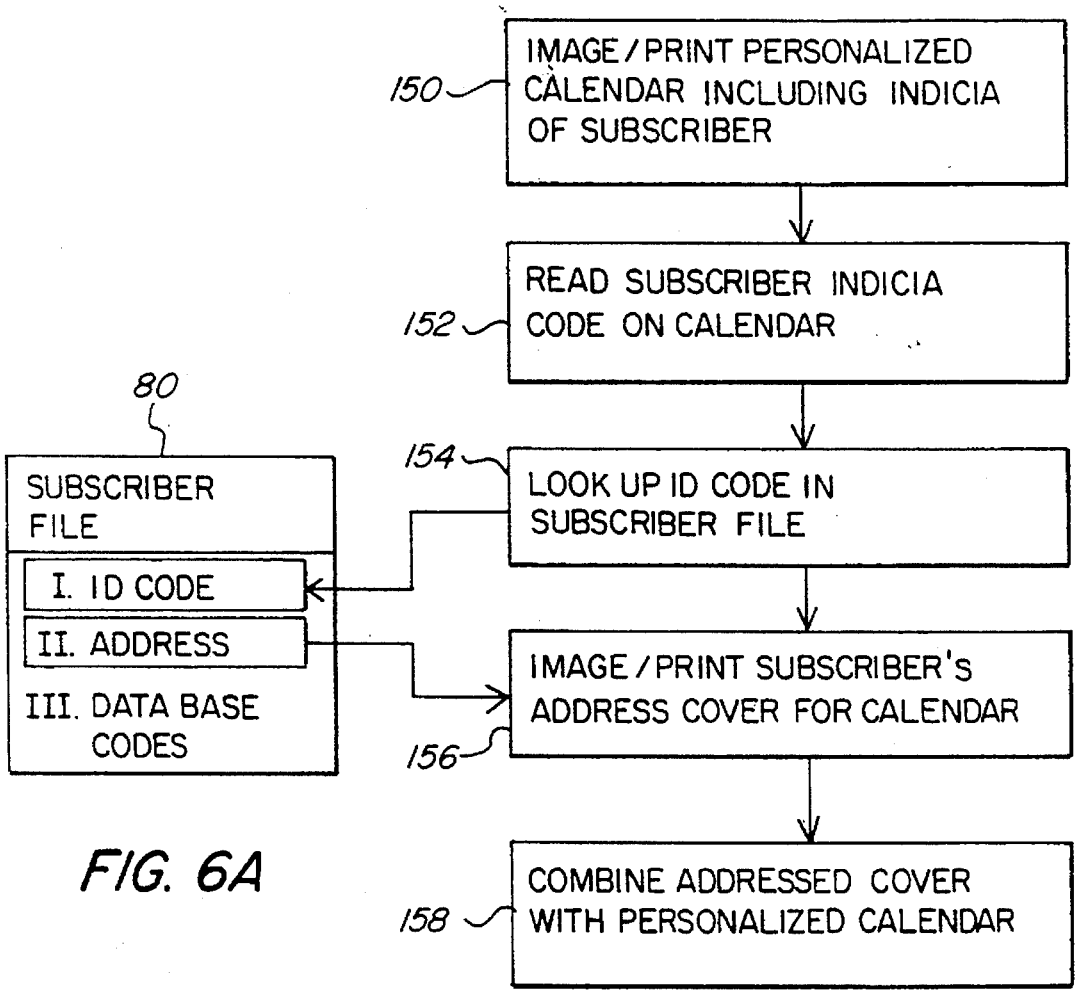
FIG. 6A is a flow diagram depicting printing/imaging and assembly of the personalized calendar of FIG. 1A.
Figure 7A:
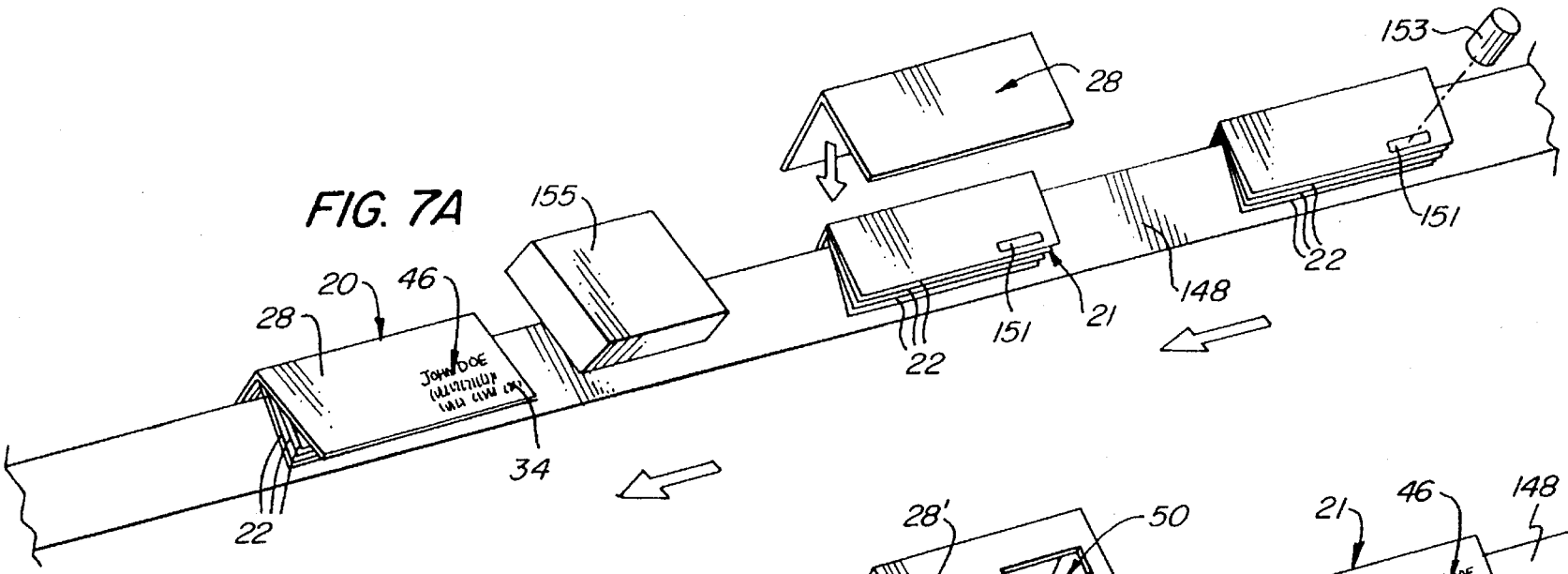
FIG. 7A is a schematic diagram depicting the addition of a personalized cover to the calendar pages of the personalized calendar of FIG. 1A.

Turning first to the flow and schematic diagrams of FIGS. 6A and 7A, personalized calendar 20 is imaged/printed at 150 including an indicia 151 of the subscriber which may be a bar code or other symbol, which is preferably retrieved from subscriber file 80. After imaging, the subscriber indicia is read by an electro-optical reader 153 or the like at 152, and looked-up at 154 in subscriber file 80 to retrieve the subscriber's address 46. Subscriber's address 46 is then imaged/printed by device 155 (preferably an ink jet) on cover 28 of personalized calendar 20 at 156. Finally, at 158, addressed cover 28 is combined with calendar pages 22 to form mailing packet 34 for personalized calendar 20. It is understood that calendar pages 22 may also be combined with cover 28 before subscriber's address 46 is printed thereon.

Figure 6B:
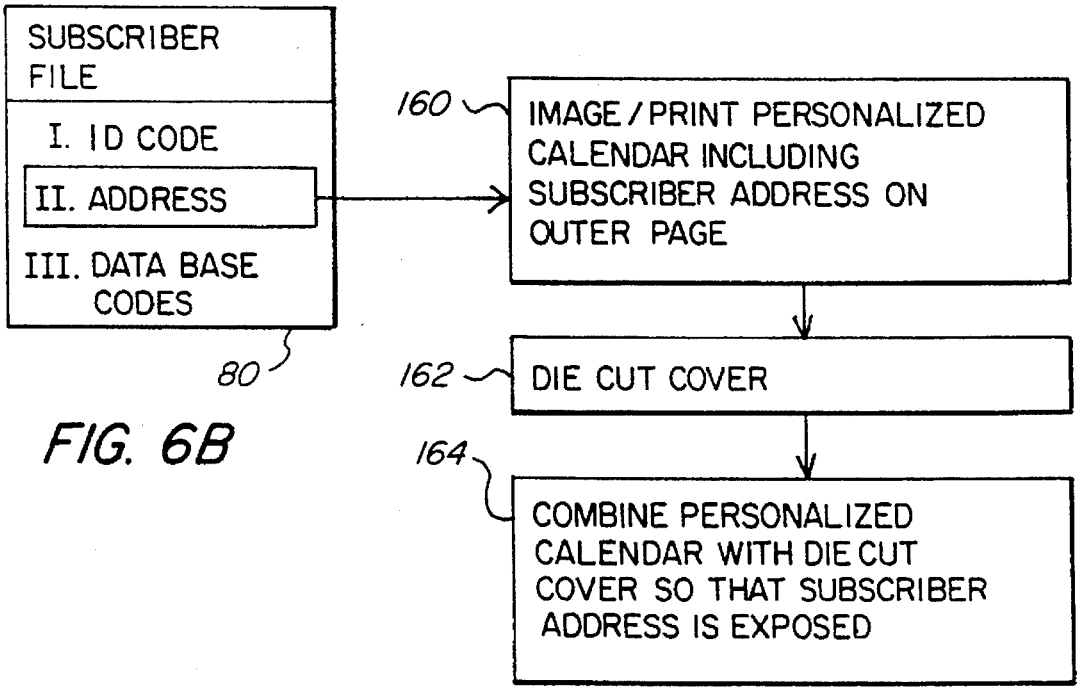
FIG. 6B is a flow diagram depicting the printing/imaging and assembly of the personalized calendar of FIG. 1B.
Figure 7B:
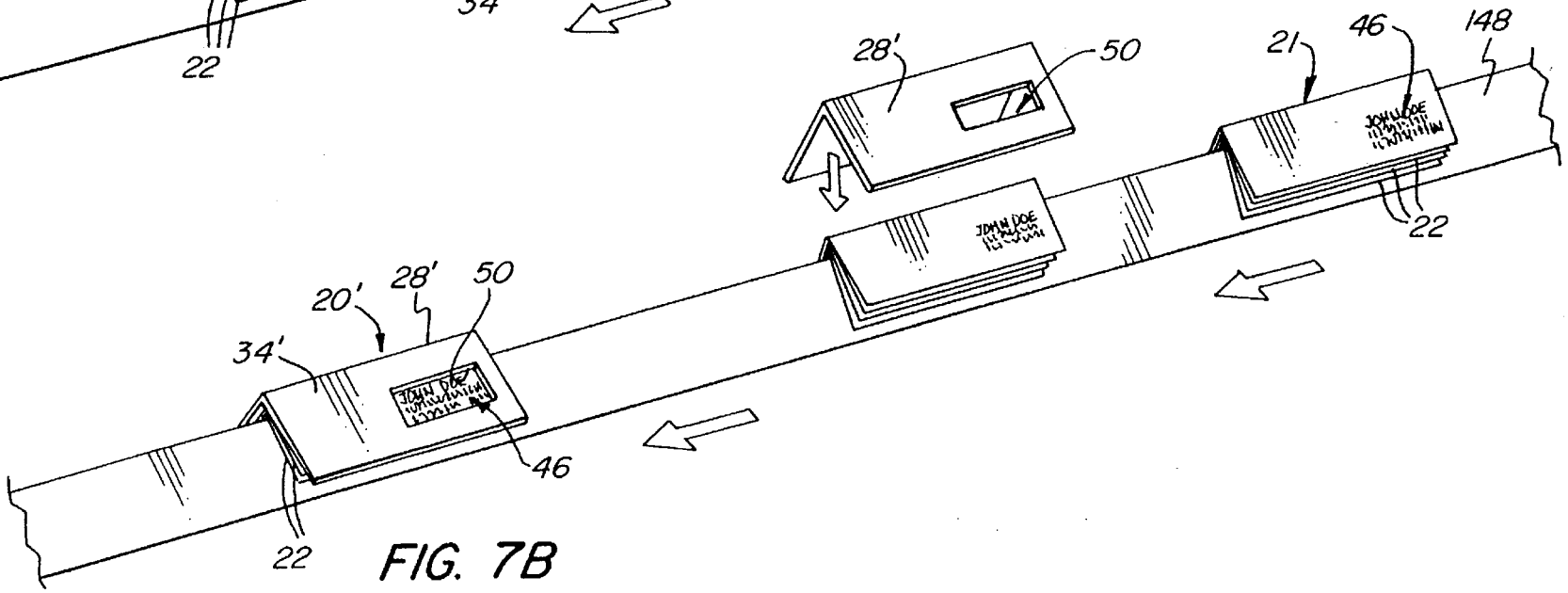
FIG. 7B is a schematic diagram depicting the addition of a die cut cover to the calendar pages of the personalized calendar of FIG. 1B.

Turning now to FIGS. 6B and 7B, personalized calendar 20' is imaged/printed at 160 including subscriber's address 46 on an outer page of calendar 20'. A cover 28' for personalized calendar 20' is die cut or the like at 162 by a device not shown in any Figure, and combined with calendar pages 22 of personalized calendar 20' at 164 so that subscriber's address 46 is exposed through window 50 in cover 28' to form a delivery packet 34'.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A Method of producing a customized calendar for a person comprising the steps of:

entering and storing in a computer the person's name and address;

entering and storing in the computer an item of data pertaining to an event of interest to the person;

providing a web of paper;

imaging with an imager numerals representing a tabular arrangement of calendar units on the provided web of paper;

imaging with an imager the event of interest to the person in an appropriate one of the calendar units;

imaging with an imager, on a page of the calendar, an indicia code to the person which is retrieved from a file of persons in the computer;

forming a plurality of calendar pages from the provided web of paper by folding and trimming the paper;

reading with a scanner the indicia code to the person in order to retrieve from the computer the name and address of the person;

printing on a flap of a cover that will be affixed to the plurality of calendar pages, the name and address of the person whose indicia code has been read from a page of the calendar by the scanner and retrieved from the computer;

forming the customized calendar by binding the plurality of calendar pages between flaps of the cover that includes the flap printed with the name and address of the person and;

sealing the cover together with a releasable adhesive for delivery of the customized calendar to the person.

2. The method of claim 1 including the step of entering and storing in a computer an updated item of data pertaining to an event of interest to the person.

3. The method of claim 1 including, before forming, the step of printing a portion of the indicia code to the person that relates to person's name and address stored in a computer on the web of paper.

4. The method of claim 3 including, after printing, the steps of reading with a scanner the indicia code of the person from the paper in order to retrieve the person's name and address.

5. The method of 1 comprising entering and storing in the computer a plurality of person's names and addresses, and including the step of storing an indicia code to each person that includes codes indicative of their interests and ID.

6. The method of claim 5 including the step of entering and storing in the computer the indicia code to each person.

7. The method of claim 5 including the step of entering and storing in the computer an updated indicia code to each person.

8. The method of claim 5 comprising entering and storing in the computer data pertaining to events of interest to the plurality of persons.

9. The method of claim 8 including, before printing an event of interest to a person, the step of finding in the computer's memory the event of interest to the person, for whom a customized calendar is being produced, by comparing the indicia code to the person with the data pertaining to events of interest to the plurality of persons.

* * * * *